US008850649B2

(12) United States Patent
Tuman et al.

(10) Patent No.: US 8,850,649 B2
(45) Date of Patent: Oct. 7, 2014

(54) CLEANING TOOL WITH UPSTANDING STEMS AND METHOD OF CLEANING A SURFACE

(75) Inventors: Scott J. Tuman, Woodbury, MN (US); Lloyd S. Vasilakes, Stillwater, MN (US); Shaelyn D. Benson, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 639 days.

(21) Appl. No.: 12/612,812

(22) Filed: Nov. 5, 2009

(65) Prior Publication Data

US 2010/0125961 A1 May 27, 2010

Related U.S. Application Data

(60) Provisional application No. 61/116,952, filed on Nov. 21, 2008.

(51) Int. Cl.

| | |
|---|---|
| ***A47L 13/00*** | (2006.01) |
| ***A47L 23/04*** | (2006.01) |
| ***A46B 9/04*** | (2006.01) |
| ***A47L 25/08*** | (2006.01) |
| *A46B 9/02* | (2006.01) |
| *A46B 9/00* | (2006.01) |

(52) U.S. Cl.

CPC . *A47L 25/08* (2013.01); *A46B 9/02* (2013.01); *A46B 9/005* (2013.01); *A46B 9/00* (2013.01); *A47L 13/00* (2013.01)

USPC ..... 15/106; 15/188; 15/104.001

(58) Field of Classification Search

CPC ..... A46B 9/00; A46B 9/02; A46B 9/005; A47L 25/08; A47L 13/00

USPC ..... 15/188, 208, 209.1, 227, 229.3, 187, 15/104.002, 104.001, 207.2, 118, 228, 15/231, 210.1, 110, 226, 223, 224, 159.1, 15/160, 106, 115, 142, 402; 428/120, 141, 428/115, 101, 119; 119/600, 611, 612, 620, 119/621, 663, 664

See application file for complete search history.

(56) References Cited

U.S. PATENT DOCUMENTS

| | | | | | |
|---|---|---|---|---|---|
| 840,328 | A | * | 1/1907 | Hickson | 15/188 |
| 1,526,267 | A | * | 2/1925 | Dessau | 15/215 |
| 1,885,572 | A | * | 11/1932 | Wood | 601/137 |
| 1,946,283 | A | * | 2/1934 | Hoffman et al. | 15/188 |
| 2,065,584 | A | * | 12/1936 | Hempel | 15/188 |
| 3,654,047 | A | | 4/1972 | Berkowitz | |
| 4,042,995 | A | * | 8/1977 | Varon | 15/142 |

(Continued)

FOREIGN PATENT DOCUMENTS

| | | | |
|---|---|---|---|
| GB | 2 300 556 | A | 11/1996 |
| WO | WO 2006/110792 | A2 | 10/2006 |
| WO | WO 2009/020749 | A1 | 2/2009 |

*Primary Examiner* — Vanitha Elgart

(57) ABSTRACT

The present disclosure relates to a cleaning tool, a cleaning sheet and method of removes debris, lint, or hair from a variety of surfaces. The cleaning tool is provided with a first array of stems and a second array of stems, wherein the first array of stems are smaller and more densely included on a cleaning surface of the cleaning tool. The larger stems are able to loosen and pull deeply embedded hair from loose fabric surfaces, while the smaller stems are able to capture and retain the loosened hair.

12 Claims, 3 Drawing Sheets

(56) References Cited

U.S. PATENT DOCUMENTS

| | | | | | |
|---|---|---|---|---|---|
| 4,111,666 | A | * | 9/1978 | Kalbow | 51/295 |
| 4,894,060 | A | | 1/1990 | Nestegard | |
| 4,975,999 | A | * | 12/1990 | Levy | 15/210.1 |
| 5,060,337 | A | * | 10/1991 | Van Niekerk | 15/111 |
| 5,072,479 | A | * | 12/1991 | Van Niekerk | 15/111 |
| 5,077,870 | A | | 1/1992 | Melbye et al. | |
| 5,524,575 | A | * | 6/1996 | Lennon | 119/625 |
| 5,607,635 | A | | 3/1997 | Melbye et al. | |
| 5,676,092 | A | | 10/1997 | Ortolivo | |
| 5,679,302 | A | | 10/1997 | Miller et al. | |
| 5,682,837 | A | * | 11/1997 | Courtney et al. | 119/625 |
| 5,845,375 | A | | 12/1998 | Miller et al. | |
| 5,879,604 | A | | 3/1999 | Melbye et al. | |
| 5,966,771 | A | * | 10/1999 | Stroud | 15/117 |
| 6,054,091 | A | | 4/2000 | Miller et al. | |
| 6,256,830 | B1 | * | 7/2001 | Jolly | 15/161 |
| 6,372,323 | B1 | | 4/2002 | Kobe et al. | |
| 6,393,648 | B1 | * | 5/2002 | Reynolds | 15/160 |
| 6,553,603 | B1 | * | 4/2003 | Jolly | 15/161 |
| 6,558,602 | B1 | | 5/2003 | Melbye et al. | |
| 6,581,236 | B2 | * | 6/2003 | Jennings | 15/188 |
| 6,610,382 | B1 | | 8/2003 | Kobe et al. | |
| 6,635,212 | B1 | | 10/2003 | Melbye et al. | |
| 6,854,153 | B1 | * | 2/2005 | Mueller | 15/210.1 |
| 6,901,622 | B2 | | 6/2005 | Thompson et al. | |
| 6,904,615 | B2 | | 6/2005 | Kobe et al. | |
| 6,962,635 | B2 | | 11/2005 | Tuman et al. | |
| 7,014,906 | B2 | | 3/2006 | Tuman et al. | |
| 7,037,457 | B2 | | 5/2006 | Seidel et al. | |
| 7,052,636 | B2 | | 5/2006 | Ausen et al. | |
| 7,284,293 | B1 | * | 10/2007 | Holder et al. | 15/104.94 |
| 7,309,519 | B2 | * | 12/2007 | Scholz et al. | 428/119 |
| 7,350,257 | B2 | | 4/2008 | McKay | |
| 7,428,768 | B2 | * | 9/2008 | Dingert | 15/231 |
| 7,921,500 | B2 | * | 4/2011 | Linzell | 15/209.1 |
| 2001/0016245 | A1 | * | 8/2001 | Tuman et al. | 428/99 |
| 2002/0115920 | A1 | | 8/2002 | Rich et al. | |
| 2003/0049407 | A1 | * | 3/2003 | Kacher et al. | 428/100 |
| 2003/0203155 | A1 | | 10/2003 | Kobe et al. | |
| 2004/0016444 | A1 | * | 1/2004 | Mitchell et al. | 134/6 |
| 2006/0130252 | A1 | * | 6/2006 | Brunner | 15/104.94 |
| 2006/0200926 | A1 | * | 9/2006 | Graham | 15/188 |
| 2006/0200927 | A1 | | 9/2006 | Kacher et al. | |
| 2006/0230559 | A1 | | 10/2006 | Knopow et al. | |
| 2006/0272115 | A1 | * | 12/2006 | Kacher et al. | 15/208 |
| 2007/0056131 | A1 | * | 3/2007 | Dingert | 15/228 |
| 2007/0107155 | A1 | * | 5/2007 | Kacher et al. | 15/209.1 |
| 2007/0130710 | A1 | * | 6/2007 | Chen et al. | 15/115 |
| 2007/0130713 | A1 | * | 6/2007 | Chen et al. | 15/209.1 |
| 2008/0035173 | A1 | | 2/2008 | Tuman et al. | |
| 2008/0244844 | A1 | * | 10/2008 | Tung | 15/104.001 |
| 2009/0031509 | A1 | * | 2/2009 | Vasilakes et al. | 15/1.52 |
| 2009/0032059 | A1 | * | 2/2009 | Tuman et al. | 134/9 |
| 2009/0056048 | A1 | * | 3/2009 | Sharifi | 15/210.1 |
| 2010/0192321 | A1 | * | 8/2010 | Tuman et al. | 15/210.1 |
| 2010/0199450 | A1 | * | 8/2010 | Linzell | 15/209.1 |
| 2011/0088186 | A1 | * | 4/2011 | Hilmann | 15/106 |
| 2011/0302733 | A1 | * | 12/2011 | Yuan | 15/104.93 |
| 2012/0036661 | A1 | * | 2/2012 | Ross | 15/104.002 |

* cited by examiner

CLEANING TOOL WITH UPSTANDING STEMS AND METHOD OF CLEANING A SURFACE

CROSS REFERENCE TO RELATED APPLICATION

This application claims the benefit of U.S. Provisional Patent Application No. 61/116952, filed Nov. 21, 2008, the disclosure of which is incorporated by reference herein in its entirety.

FIELD

The present disclosure relates to a cleaning tool comprising upstanding stems, and a method of cleaning a surface. In particular, the present disclosure relates to a cleaning material for gathering or removing debris, lint, or hair from a variety of surfaces by using a combination of small and large upstanding stems.

BACKGROUND

Adhesive or other tacky lint removal devices, such as lint rollers, or directional felted fabric, such as disclosed in U.S. Pat. No. 6,901,622 can be used to remove lint and debris, such as particles, dirt, or hair from a surface. Hair embedded into fabric surfaces presents a particular challenge to remove as the hair is often entangled into the fabric surface.

For adhesive lint removal devices, the adhesive may not be strong enough to capture strongly embedded hair. Also, even if the adhesive sheet can retain the hair, often the adhesive sheet becomes loaded with debris so quickly that it becomes inefficient to clean a large area or an area having heavy debris cover. For directional felted fabric, the fabric is only useful at removing debris, lint, or hair by use in one direction. Further, once the fabric becomes loaded with debris, the user must remove the debris to continue use as these types of materials are typically not disposable.

SUMMARY

The present disclosure relates to a cleaning tool that removes debris, lint, or hair from a variety of surfaces. In particular, the cleaning tool is highly effective at removing embedded hair from fabric, upholstered, or carpeted surfaces. The cleaning tool is provided with a first array of stems and a second array of stems, wherein the first array of stems are smaller and more densely included on a cleaning surface of the cleaning tool. The larger stems are able to loosen and pull deeply embedded hair from loose fabric surfaces, while the smaller stems are able to capture and retain the loosened hair.

In one embodiment, a cleaning tool is disclosed. The cleaning tool comprises a working surface, a first array of stems comprising from 20 to 1000 upstanding stems per square centimeter projecting from the working surface, wherein each stem of the first array has a height from 0.2 and 2.0 millimeters and a shore hardness less than 105A, and a second array of stems comprising from 0.1 to 3 upstanding stems per square centimeter projecting from the working surface, wherein each stem of the second array has a height from 2.5 to 25 millimeters and a shore hardness less than 105 A. The first and second array of stems are wiped over a surface to be cleaned to gather debris, lint, or hair.

In one embodiment, a cleaning sheet is disclosed. The cleaning sheet comprises a first area including a first array of stems comprising from 20 to 1000 upstanding stems per square centimeter projecting from the working surface, wherein each stem of the first array has a height from 0.2 and 2.0 millimeters and a shore hardness less than 105 A and a second area including a second array of stems comprising from 0.1 to 3 upstanding stems per square centimeter projecting from the working surface, wherein each stem of the second array has a height from 2.5 to 25 millimeters and a shore hardness less than 105 A.

In another embodiment, the cleaning sheet comprises a first array of stems comprising from 20 to 1000 upstanding stems per square centimeter projecting from the working surface, wherein each stem of the first array has a height from 0.2 and 2.0 millimeters and a shore hardness less than 105 A and a second array of stems comprising from 0.1 to 3 upstanding stems per square centimeter projecting from the working surface, wherein each stem of the second array has a height from 2.5 to 25 millimeters and a shore hardness less than 105 A. The second array of stems are distributed within the first array of stems.

In another embodiment, a method of cleaning a surface is disclosed. The method comprises providing a cleaning tool comprising a backing and projecting from the backing is a first array of stems comprising from 20 to 1000 upstanding stems per square centimeter, wherein each stem of the first array has a height from 0.2 and 2.0 millimeters and a shore hardness less than 105 A and a second array of stems comprising from 1 to 5 upstanding stems per square centimeter, wherein each stem of the second array has a height from 5 to 50 millimeters and a shore hardness less than 105 A, wiping the first and second array of stems over a surface to be cleaned, loosening lint, hair or debris on the surface to be cleaned with the stems of the second array, and capturing lint, hair or debris with the stems of the first array.

While the above-identified drawings and figures set forth embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of this invention. The figures may not be drawn to scale.

DETAILED DESCRIPTION

Figure 1:
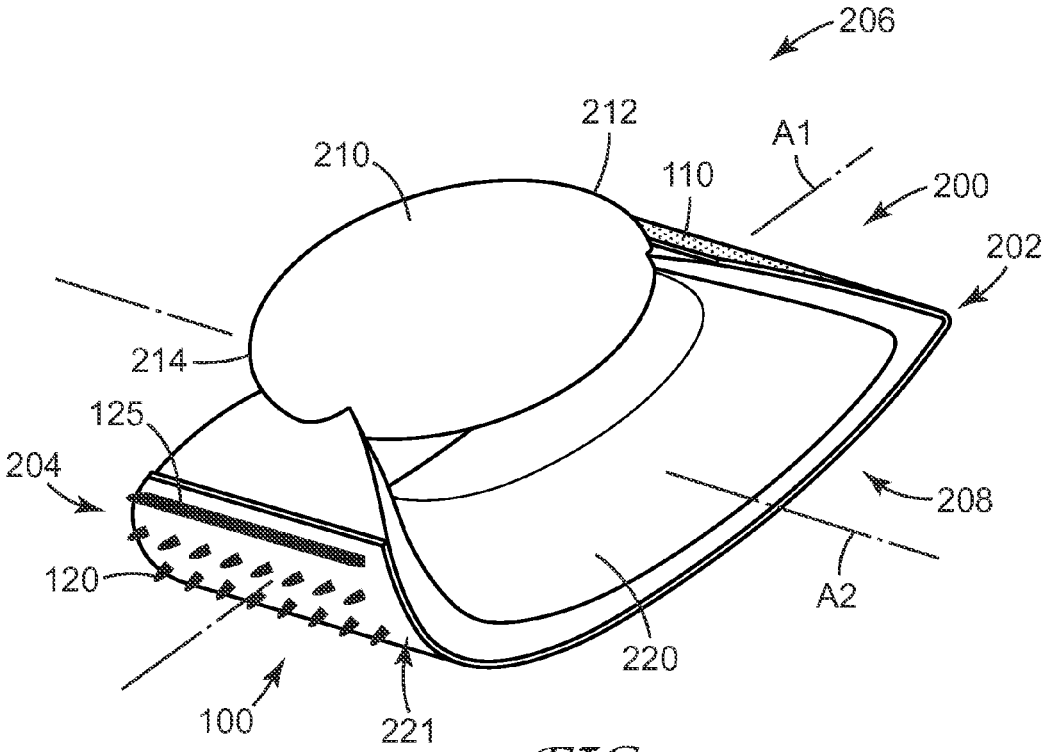
FIG. 1 is a perspective view of one embodiment of a cleaning tool.
Figure 2:
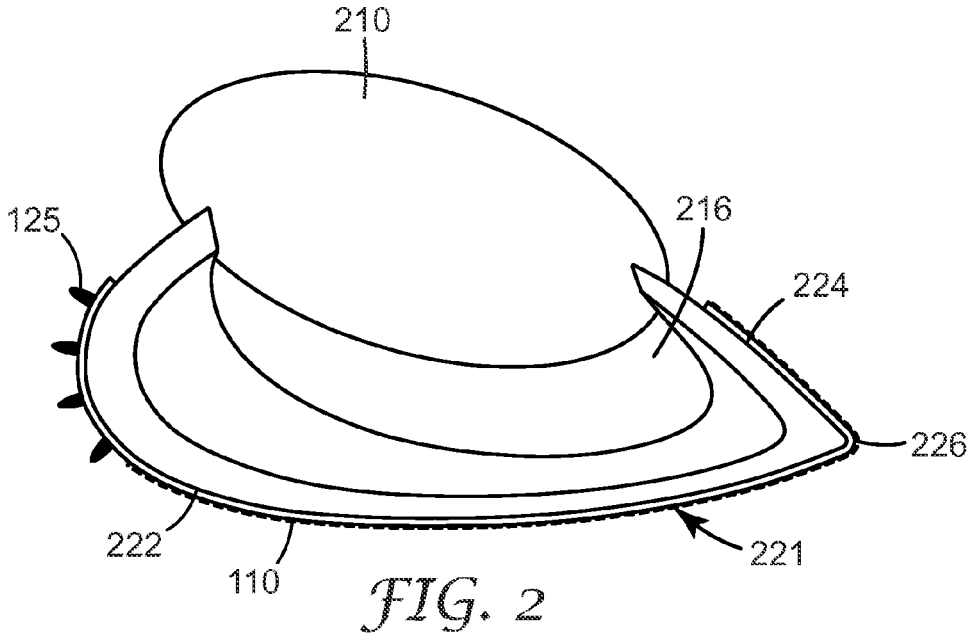
FIG. 2 is a side view of the cleaning tool of FIG. 1.

FIG. 1 is a perspective view of one embodiment of a cleaning tool 200 that includes a cleaning material 100. In particular, in this embodiment, the cleaning material 100 is a sheet that removably attaches to the cleaning tool 200. FIG. 2 is a side view of the cleaning material 100 and cleaning tool 200 of FIG. 1. The cleaning tool 200 includes a body 220, and in this embodiment the cleaning tool 200 includes an optional handle 210.

The body 220 of the cleaning tool 200 is shown oriented about a first axis A1 and second axis A2. The body 220 of the cleaning tool 200 has a first end 202, a second end 204 opposite the first end 202, a proximal region 206, in this embodiment referred to as an upper region, and a distal region 208, in this embodiment referred to as a bottom region. The body of the cleaning tool 200 includes a working surface 221. The working surface 221 supports the cleaning material 100 to make contact with the surface to be cleaned and perform the cleaning function.

In this embodiment, the working surface 221 includes convexly curved surface 222 and a top face 224. The convexly curved surface 222 extends along the direction of axis A1 from the body first end 202, to the body second end 204 and continues a curve around the body second end 204. It is understood that the curve of the convexly curved surface may have a single radius of curvature over the whole surface or may have a varying radius of curvature. The top face 224 extends from the body first end 202, however is generally opposite the convexly curved surface 222. In this embodiment, the top face 224 is a planar surface, however it may be curved (convex or concave), stepped, textured, irregular, or other shape or configuration. The top face 224 and convexly curved surface 222 converge together at the first end 202 of the cleaning tool 200 to form a tapered portion 226.

In the embodiment shown in FIGS. 1 and 2, the working surface 221 is generally not curved along the direction of axis A2. It is understood that the working surface may be curved (convex or convex), stepped, textured, irregular, or other shape or configuration in a direction along axis A2.

The cleaning tool 200 includes an optional handle 210 to provide a mechanism for a user to securely hold the cleaning tool. In this embodiment, the handle includes a first end 212 and a second end 214 that are integrally attached to the body 220 of the cleaning tool 200. Generally, the handle first end 212 is adjacent the top face 224 near the body first end 202, and the handle second end 214 is adjacent the convexly curved surface 222 near the body second end 204. A recess or cavity 216 is included to allow a hand to grip around the handle 210 and fingers to recess into the cavity 216.

Figure 4:
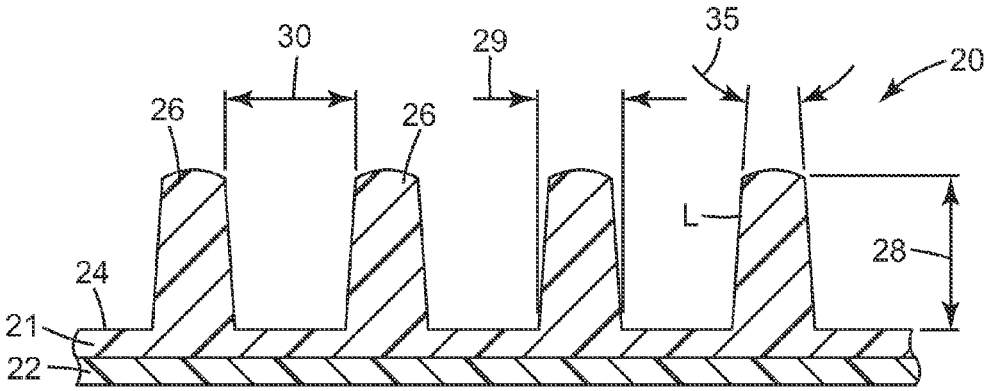
FIG. 4 is a side view of an array of stems.

The cleaning material 100 comprises a first array of stems 110 and a second array of stems 120. The first array of stems 110 and second array of stem 120 are shown separate from one another. Unlike directional fabric, an array of stems can be wiped across a surface in any direction and gather and capture debris, lint, or hair. Generally, the first array of stems 110 is more densely arranged and shorter than the second array of stems 120. FIG. 4 shows an arrangement of stems 26 that will be used to describe the physical parameters of the first array of stems 110 and second array of stems 120.

The first array of stems 110 generally comprises a dense arrangement of small stems.

With reference to FIG. 4, the stems 26 typically have a height in the range of about 0.2 mm to about 3 mm, preferably about 0.5 mm to about 1.5 mm. The separation or gap 30 between adjacent stems 26 is generally in the range of about 0.25 mm and about 2.5 mm and more typically in the range of about 0.4 mm to about 1.0 mm. This separation gap creates a percent of free volume that is volume within the stem web that is not occupied by the stems. The percent of free volume is typically from 60 to 98% of the stem web and more typically from 85 to 95%. The larger the free volume, the larger volume is available for loading with debris, lint or hair. The stems 26 have a maximum cross sectional dimension 29 of about 0.076 mm to about 0.76 mm. The stems 26 can be arranged in a density of at least 20 per square centimeter, and more typically at least 50 per square centimeter. The stem density is generally at most about 1000 per centimeter squared, more typically at most about 500 per centimeter squared.

The second array of stems 120 generally comprise a less dense arrangement of larger stems, relative to the first array of stems 110. With reference to FIG. 4, the stems 26 typically have a height 28 in the range of about 2.5 mm to about 25 mm, preferably about 5 mm to about 17 mm. The stems 26 have a minimum cross sectional dimension 29 of at least 1.0 mm. In another embodiment, the stems 26 have a minimum cross section dimension 29 of at least 3.0 mm. The stems 26 can be arranged in a density of generally less than 3 per square centimeter, and more typically less than 2 per square centimeter. In one embodiment, the stem density is generally at least 0.1 per square centimeter, more typically at least 0.5 per square centimeter. In one embodiment, at least a portion of the second array of stems 120 are directly adjacent one another to form a rib 125. This rib is relatively flexible and can function as a squeegee-like cleaning zone.

As shown in FIG. 4, the stem web 20 includes a backing layer 21 having a first surface 24 with an array of generally upstanding stems 26. The stems may be arranged in a regular or an irregular array. Various patterns of stems may be used, such as hexagonal, diagonal, sinusoidal, etc. The stems 26 are constructed at least in part of an elastomeric material. Preferably, the entire exterior surface of the stems 26 is an elastomeric material. In the embodiment of FIG. 4, the backing layer 21 is integrally formed with the stems 26 of an elastomeric material. Although the illustrated embodiment shows the stems 26 as being generally cylindrical, the sides of the stems 26 typically have a slight taper 35 to facilitate removal from the mold during formation. As shown in FIG. 4, the taper 35 is inward from the base to the tip of the stem. It is understood, that the stem may be constructed having a taper outward from the base to the tip of the stem. A variety of non-cylindrical shapes can also be utilized, such as truncated cones or pyramids, rectangles, hemispheres, squares, hexagon, octagon, gum drops, and the like. The pattern of the array, the shape or arrangement of the first array of stems 110 may be different than that of the second array of stems 120.

A stem, for purposes of this disclosure, is distinguished from a hook. A stem is a protrusion that projects from a surface but does not form an interlocking fastening system like a hook may with a mating surface. Hooks generally have an overhang, or other portion that projects laterally from the main body of the hook to create the interlocking fastening system. A stem, alternatively, typically does not have a portion that projects laterally from the main body of the stem. As can be seen in the embodiment in FIG. 4, the stem 26 does not include a portion that projects laterally and instead has a linear side (as indicated by L as a line extending generally from the backing toward the tip of the stem).

Stems that are generally upstanding tend to optimize the performance of the cleaning material 100. The stems are kept upstanding by the stem diameter and the nature of the elastomeric material. As shown in the embodiment of FIG. 4, the upstanding stems angle relative to the backing is 90 degrees. However, an upstanding stems may be angled from 40 to 90 degrees relative to the backing Additionally, the stems may be multi-angled such that different stems can angle in different directions. The first array of stems 110 may have the same angular orientation or may have different angular orientation relative to the second array of stems 120.

Suitable materials for the stem web include elastomers. The elastomer and elastomer properties of the first array of stems 110 may be the same as or different than that of the second array of stems 120. The elastomer should have a Shore Hardness less than 105 A. In one embodiment, the elastomer has a Shore Hardness less than 85 A. Suitable materials include thermoplastic polyurethanes, polyvinyl chlorides, polyamides, polyimides, polyolefins (e.g., polyethylene and polypropylene), polyesters (e.g., polyethylene terephthalate), polystyrenes, nylons, acetals, block polymers (e.g., polystyrene materials with elastomeric segments, available from KRATON Polymers Company of Houston, Texas, under the designation KRATON™, polycarbonates, thermoplastic elastomers (e.g., polyolefin, polyester or nylon types) and copolymers and blends thereof. The thermoplastic material may also contain additives, including but not limited to fillers, fibers, antistatic agents, lubricants, wetting agents, foaming agents, surfactants, pigments, dyes, coupling agents, plasticizers, suspending agents, hydrophilic/hydrophobic additives, adhesives and tacky polymers, and the like.

Secured to the backing 21 may be an optional layer 22 that may serve as a reinforcing layer or attachment layer. The layer 22 may impart increased tear resistance or tensile strength to the stem web. The layer 22 may serve as an attachment mechanism. For example, layer 22 may be an adhesive layer for adhesively securing the stem web 20 to a surface. Layer 22 may provide a hook or loop surface to attach to other hooks for securing the stem web 20 to another surface, like a cleaning tool. If layer 22 is serving as an attachment mechanism, layer 22 may be a woven, knitted, or nonwoven material that provides a loop for attachment to a hook. Layer 22 may be a foamed or a solid polymeric material. It may include a porous and/or absorbent layer, such as layers of fibrous material or fabric scrim which may be woven or nonwoven. A porous material is useful for absorbing moisture and/or directing moisture away from the stems. In one embodiment, the layer 22 includes a substantially inelastic layer to prevent necking or stretching of the stem web.

The first array of stems 110 is densely formed of stems that are easily able to grip and entangle material within adjacent stems. However, the free volume of the first array of stems 110 provides sufficient open space for the debris, line or hair to become trapped in and held by the stem web. With a free volume from 60 to 98% of the first array of stems 110, a signification portion of the first array of stems is available for loading of the debris, lint or hair.

The second array of stems 120 includes larger stems that are more durable and able to penetrate further into loose or fluffy material such as carpets to catch and entangle hair embedded within. The second array of stems 120 is able to pull the deeply embedded hair sufficiently to the surface such that the first array of stems 110 can grip and entangle the loosened material.

Typically, because the first array of stems 110 is provided to grip and entangle the material, the area provided by the first array of stems 110 is at least 2 times greater than the area provided by the second array of stems 120. In another embodiment, the area provided by the first array of stems 110 is at least 3 times greater than the area provided by the second array of stems 120.

Typically, because the second array of stems 120 are provided to penetrate further into the fabric being cleaned than the first array of stems 110, the height of the second array of stems 120 is at least 3 times greater than the first array of stems 110. In another embodiment, the height of the second array of stems 120 is at least 4 times greater than the first array of stems 110.

Unlike a hook that could catch or snag fabric, an array of stems results in minimal damage when wiped repeatedly over a variety of surfaces, such as fabric and upholstery. Therefore, the stem can be repeatedly used to clean such things as clothing, furniture, carpeting to remove debris, lint or hair without excessive wear.

Figure 3:
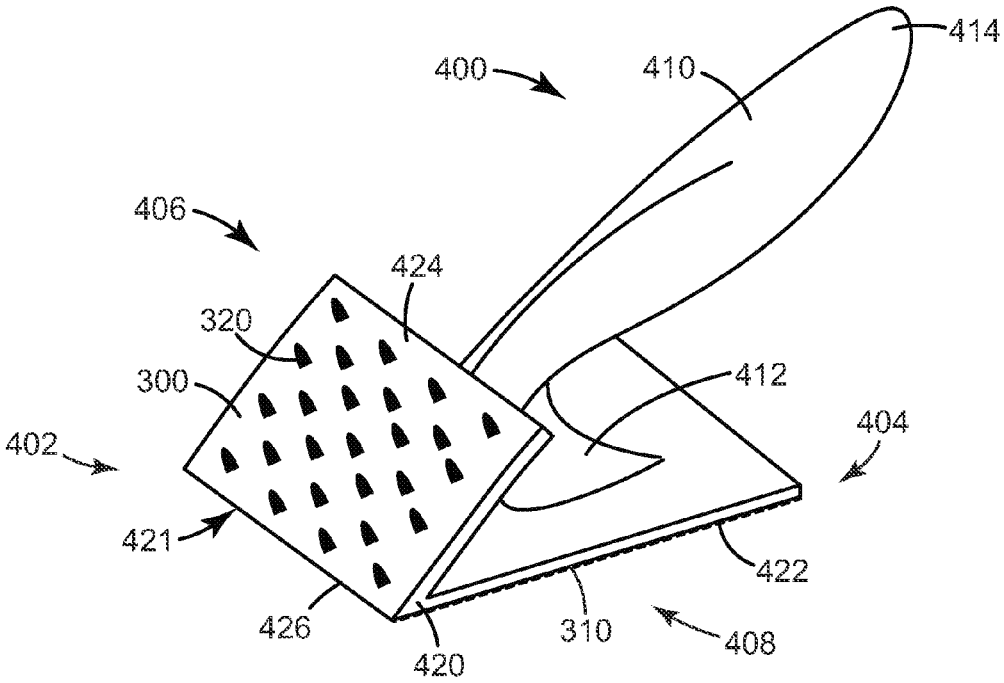
FIG. 3 is a side view of a second embodiment of a cleaning tool.

FIG. 3 is a perspective view of another embodiment of a cleaning tool 400 comprising a cleaning material 300. In particular, in this embodiment, the cleaning material 300 is permanently secured and not intended to be removed from the cleaning tool 400. The cleaning tool 400 includes a body 420, and in this embodiment the cleaning tool 400 includes an optional handle 410. It is understood that the cleaning material may be a sheet permanently secured to the cleaning tool 400 or in some embodiment may be integrally formed with the cleaning tool 400.

The body 420 of the cleaning tool 400 has a first end 402, a second end 404 opposite the first end 402, a proximal region 406, in this embodiment referred to as an upper region, and a distal region 408, in this embodiment referred to as a bottom region. The body of the cleaning tool 400 includes a working surface 421. The working surface 421 supports the cleaning material 300 to make contact with the surface to be cleaned and perform the cleaning function.

In this embodiment, the working surface 421 includes planar surface 422 and a top face 424. The planar surface 422 extends from the body first end 402 to the body second end 404. The top face 424 extends from the body first end 402, however is generally opposite the planar surface 422. In this embodiment, the top face 424 is a planar surface, however it may be curved (convex or concave), textured, irregular, or other shape or configuration. The top face 424 and planar surface 422 converge together at the first end 402 of the cleaning tool 400 to form a tapered portion 426.

The cleaning tool 400 includes a handle 410. In this embodiment, the handle includes a first end 412 and a second end 414. The handle first end 412 is attached to the body 420, while the handle second end 414 remains unattached to the body 420. The handle first end 412 projects from the body 420, opposite the planar surface 422. It is understood that a variety of handle shapes, configurations, and placements may be used to allow a user to securely grip the cleaning tool 400.

The cleaning material 300 includes a first array of stems 310 and second array of stems 320, as described above with respect to FIGS. 1 and 2. FIG. 3 shows the first and second array of stems integrally formed on the cleaning tool 400. However, it is understood that the first array of stems 310 may be provided on a sheet and the second array of stems 320 may be provided on a second sheet. It is understood that the first array of stems 310 and second array of stems 320 may be provided on a single sheet.

Two embodiments of cleaning tools have been shown and described. However, it is understood that a variety of various shapes, sizes and configurations of the cleaning tool, supporting the cleaning material that comprises a first array of stems 110 and a second array of stems 120 may be used. For example, the working surface may have planar, non-planar, uniformly curved, non-uniformly curved, stepped, irregular, or micro or macro textured surface(s) that support the cleaning material. Also, the working surface may be hard and rigid or may partially or entirely include a layer of deformable, conformable, or flexible material such as, for example, foam or sponge. Also, the cleaning materials shown include a variety of surfaces. It is understood that a single surface, such as, a planar, non-planar, or curved may be used. Therefore, the tapered region is not essential and is optional.

The convexly curved surface 222 of FIGS. 1 and 2 provides a particularly advantageous surface for supporting the first array of stems 110. To use the cleaning material, the user may first contact the surface to be cleaned with the second array of stems 120 to penetrate into the fabric to pull deeply embedded hair. Then the user would contact the surface to be cleaned with the first array of stems 110. In one embodiment, the user wipes the cleaning material over the surface to be cleaned. With a convexly curved surface supporting the first array of stems 110, the user can "roll" the convexly curved surface 222 with the wiping motion over the surface to be cleaned. Such a curved surface and wiping motion allows for many separate contact points on the first array of stems 110 to make contact with the surface to be cleaned and maximize gathering and capturing debris, lint, and hair. A planar surface is suitable for the cleaning material, as shown in FIG. 3. However, by wiping a planar surface over a surface to be cleaned, often the debris, lint and hair will collect at a leading edge and have a "snowplowing" effect, minimizing the ability of the cleaning material to gather or capture debris, lint and hair.

As opposed to a convexly curved surface, other non-planar surfaces, having uniform, or random arrays of structures such as ridges, peaks, or bumps may be suitable in preventing snowplowing and enhancing gathering or capturing of debris, lint or hair. A spacer or glider may be included that provides a low friction surface to remove or recess the cleaning surface. The spacer or glider may be in the form of a fin, rail, bumps, ridges, or other protrusions. To further enhance this ability, it may be advantageous to also include a convexly curved surface along the direction of another axis.

A tapered region 226, 426 provides a particularly advantageous combination of surfaces for supporting the first array of stems 110. The tapered region creates a narrowed portion or point having the first array of stems 110 on opposed directions available for cleaning. The tapered region provides a particularly desirable feature for gathering or capturing debris, lint, or hair in the crease of a chair, sofa, or the like, in the area where the back meets the seat.

The cleaning tool may comprise other portions of the working surface with cleaning materials in addition to the first and second stems. For example, one suitable cleaning material is a directional fabric, such as disclosed in U.S. Pat. No. 6,901,622, or woven, knitted, or nonwoven fabric. Another suitable cleaning material is an adhesive surface. The adhesive surface may be integrally formed on the working surface of the cleaning tool or may be on a sheet placed over the working surface. For example, an adhesive sheet may be an adhesive coated film or paper. Another suitable cleaning material comprises protrusions such as hooks. The hook may be integrally formed on the working surface of the cleaning tool or may be on a sheet removable from or permanently secured to the working surface.

Figure 5:
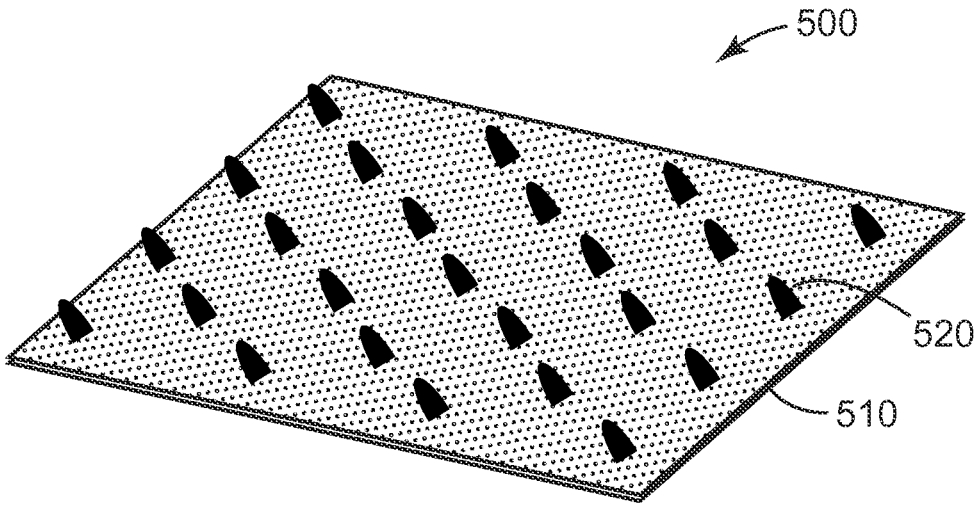
FIG. 5 is a perspective view of an embodiment of a cleaning material.

If the cleaning material is in sheet form, two separate individual sheets may be provided: one sheet containing the first array of stems 110 and a second sheet containing the second array of stems 120. In another embodiment, a single sheet may contain the first array of stems 110 and second array of stems 120. The first array of stems 110 may be in one area of the sheet while the second array of stems 120 may be on a separate area of the sheet, such as shown on the sheet of FIG. 1. In another embodiment, the second array of stems 520 may be contained within the first array of stems 510, such as shown by the sheet 500 of FIG. 5. In the embodiment where the first array of stems and second array of stems are provided on a single sheet, it is understood that the sheet may be used without a separate cleaning tool. In such an instance a user may simply use his or her hand to wipe the sheet material over a surface.

If a single sheet or multiple sheets are used in conjunction with a cleaning tool, the sheet or the cleaning tool will include an attachment mechanism for securing the sheet to the cleaning tool. During use a wiping motion causes frictional forces between the cleaning material and the surface to be cleaned. The attachment mechanism should form a secure connection between the cleaning material (sheet) and the working surface of the cleaning tool so that the cleaning material does not slip or remove from the working surface. In one embodiment, the cleaning material is secured to the working surface such that the cleaning material is securely placed under tension in the direction of intended wiping. For example, with reference to FIGS. 1 and 2, the attachment may be simply attached at the cleaning tool first end 202 and the cleaning tool second end 204 as the intended wiping direction is along axis A1. Additionally, a cleaning material that exhibits a slight elasticity has a better ability to be placed under tension by securing opposing ends.

The back of the sheet may include an adhesive layer for permanent or releasable attachment to a cleaning tool. Alternatively, the cleaning tool may include the adhesive for permanent or releasable attachment to a sheet of a cleaning material. The back of the sheet may include a hook or loop layer for attachment to hooks on the cleaning tool. For example, a knitted or nonwoven material may be used as a loop for connection to hooks on the cleaning tool. The attachment mechanism is located at least at the body first end and the body second end for secure attachment of the sheet so that during a wiping motion the cleaning material remains securely connected to the cleaning tool. In one embodiment the entire area of contact between the cleaning material and the working surface includes an attachment mechanism. In another embodiment, such as where the attachment mechanism is a hook on the cleaning tool, the hooks are slightly recessed from the perimeter of the working surface to avoid the hooks from snagging or damaging the surface to be cleaned. Alternatively, the sheet may be larger in size than the working surface such that the sheet wraps up and around the working surface. An attachment mechanism may be appropriately located to securely hold the sheet up and around the working surface.

To use the cleaning material, the user will contact the cleaning material over a surface to be cleaned. In particular, the user will wipe the second array of stems over the surface to pull out deeply embedded material, such as hair. This is particularly useful when the surface being cleaned is a lofty, fluffy, or very fibrous material such as carpet. Then the first array of stem is wiped over the surface to gather or capture debris, lint, or hair that is loose on the surface being cleaned. The gathered or captured debris, lint, or hair is removed from the surface being cleaning In one embodiment, at least the first array of stems, which is more suited for gathering and capturing the material, is removable from the cleaning tool and is disposable. Therefore, following cleaning, at least the first array of stems, along with the captured debris, lint, or hair, is discarded.

In another embodiment, following capture of the debris, lint, or hair, the cleaning material itself may be cleaned to remove some or all of the debris, lint, or hair. Then, the cleaning material may be reused for further cleaning applications. In such an embodiment, the cleaning material may be continually reused or may be disposable after one or several uses.

Although specific embodiments of this invention have been shown and described herein, it is understood that these embodiments are merely illustrative of the many possible specific arrangements that can be devised in application of the principles of the invention. Numerous and varied other arrangements can be devised in accordance with these principles by those of ordinary skill in the art without departing from the spirit and scope of the invention. Thus, the scope of the present invention should not be limited to the structures described in this application, but only by the structures described by the language of the claims and the equivalents of those structures.

What is claimed is:

1. A cleaning tool comprising:

a working surface;

a first array of stems comprising from 20 to 1000 upstanding stems per square centimeter projecting from the working surface, wherein each stem of the first array has a height from 0.2 and 2.0 millimeters and a shore hardness less than 105 A;

a second array of stems comprising from 0.1 to 3 upstanding stems per square centimeter projecting from the working surface, wherein each stem of the second array has a height from 2.5 to 25 millimeters and a shore hardness less than 105 A;

wherein the first and second array of stems are wiped over a surface to be cleaned to gather debris, lint, or hair;

wherein at least one of the first and second arrays of stems is formed by a cleaning material removably secured to the working surface such that upon removal of the cleaning material from the working surface, the corresponding at least one of the first and second arrays of stems is removed from the working surface.

2. The cleaning tool of claim 1, wherein the stems of the second array are at least 3 times higher than the stems of the first array.

3. The cleaning tool of claim 1, wherein an area of the first array is at least 2 times the area of the second array.

4. The cleaning tool of claim 1, wherein the working surface includes a first surface containing the first array of stems and a second surface containing the second array of stems.

5. The cleaning tool of claim 1, wherein the second array of stems is contained within the first array of stems.

6. The cleaning tool of claim 1, wherein the cleaning material includes a first sheet material comprising the first array of stems, wherein the first sheet material is secured to the working surface.

7. The cleaning tool of claim 6, wherein the cleaning material further includes a second sheet material comprising the second array of stems, wherein the second sheet material is secured to the working surface, and further wherein the first sheet material is separate from the second sheet material.

8. The cleaning tool of claim 1, wherein the cleaning material is sheet material comprising the first array of stems and the second array of stems.

9. The cleaning tool of claim 8, wherein the first array of stems is separate from the second array of stems.

10. The cleaning tool of claim 8, wherein the second array of stems is contained within the first array of stems.

11. The cleaning tool of claim 1, wherein at least a portion of the second array of stems are directly adjacent one another to form a rib.

12. The cleaning tool of claim 1, wherein the working surface includes an adhesive.

* * * * *